United States Patent [19]

Minezaki

[11] 4,272,254

[45] Jun. 9, 1981

[54] HYDROCARBON FUEL HAVING IMPROVED COMBUSTION EFFICIENCY

[76] Inventor: Takashi Minezaki, 2-18-14 Hon-cho, Shibuya-ku, Tokyo, Japan

[21] Appl. No.: 133,293

[22] Filed: Mar. 24, 1980

[30] Foreign Application Priority Data

Mar. 20, 1979 [JP] Japan ..... 54-32510

[51] Int. Cl.[3] ..... C10L 1/28

[52] U.S. Cl. ..... 44/70; 44/76; 556/439

[58] Field of Search ..... 44/70, 76; 556/439

[56] References Cited

U.S. PATENT DOCUMENTS

| | | | |
|---|---|---|---|
| 3,112,333 | 11/1963 | Bailey | 556/439 |
| 3,182,076 | 5/1965 | Holdstock | 556/439 |

*Primary Examiner*—Patrick Garvin
*Assistant Examiner*—Y. Harris-Smith
*Attorney, Agent, or Firm*—Wenderoth, Lind & Ponack

[57] ABSTRACT

A hydrocarbon fuel very highly improved in combustion efficiency and not generating any harmful substances. It is obtained by adding a compound of organic silicon of the formula, $(SiCH_2CH_2COOH)_nO_3$, to an ordinary hydrocarbon fuel, such as gasoline, kerosene or the like.

2 Claims, No Drawings

HYDROCARBON FUEL HAVING IMPROVED COMBUSTION EFFICIENCY

BACKGROUND OF THE INVENTION

1. Field of the Invention:

The present invention relates to a hydrocarbon fuel having improved combustion efficiency and, more particularly, to a hydrocarbon fuel having improved combustion efficiency by adding to an ordinary hydrocarbon fuel an organic silicon compound having at one end of a fatty acid polysiloxane

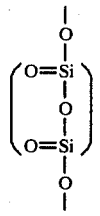

2. Description of the Prior Art

Recently, carbon monoxide, hydrocarbon and nitrogen oxides contained in an exhaust gas from an automobile engine have posed a very serious problem of environmental pollution. It is widely known as a means for overcoming this problem to add a compound of organic germanium to an ordinary hydrocarbon fuel. However, this fuel consisting of hydrocarbon fuel and a compound of organic germanium generates germanium oxide ($GeO_2$) is harmful to the human body, and is difficult to obtain and very expensive, so that it has not been put to practical use.

Moreover, it has been proven that a hydrocarbon fuel to which a compound of organic germanium is added is not suitable as fuel for an internal combustion engine and a stove for heating purposes since the compound of organic germanium is decomposed at a temperature of around 80° C.

3. Summary of the Invention:

An object of the present invention is to provide a hydrocarbon fuel of an improved quality free from problems of environmental pollution.

To this end, the present invention provides a hydrocarbon fuel having improved combustion efficiency by adding to an ordinary hydrocarbon fuel an organic silicon compound obtained by synthesis on the basis of silicon.

Silicon referred to above belongs to the same group as germanium and can be obtained comparatively easily. The temperature at which the compound of organic silicon mentioned above is decomposed is approximately 200° C. so that it is not decomposed before the combustion of the hydrocarbon fuel has been completed. Namely, a compound of organic silicon added to the hydrocarbon fuel displays a perfect performance during the combustion of the fuel.

DESCRIPTION OF THE PREFERRED EMBODIMENTS

The present invention proposes, upon recognition of silicon which is of the same group as the germanium of the aforementioned germanium compound and available comparatively easily, to add an organic silicon compound synthesized from the silicon to a hydrocarbon fuel thereby to produce a less expensive and less-polluting fuel, generating only small amounts of noxious substances. Since the decomposition of the silicon compound takes place at a temperature around 200° C., the silicon compound is never decomposed before the combustion, to serve as expected in the course of combustion.

The above-mentioned silicon compound can be synthesized by the following steps. At first, trichlorosilane ethyl cyanide is produced by reacting acrylonitrile with trichlorosilane. Then, a hydrolysis is effected to produce trichlorosilane ethyl carboxylic acid. Then, by the action of thionyl chloride, trichlorosilane propionic acid is produced which is then hydrolyzed into β-carboxy ethyl polysiloxane, i.e. an organic silicon compound.

The above-explained synthesizing process is expressed by the following formula.

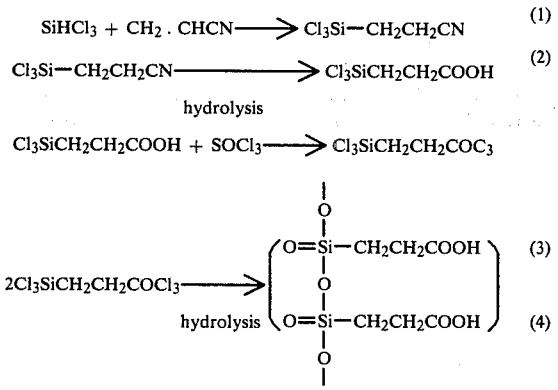

The organic compound added to a hydrocarbon fuel such as gasoline can assist the oxidation of each component in the combustion system of the hydrocarbon fuel. More specifically, carbon monoxide is changed to carbon dioxide, while the hydrocarbon is decomposed into water and carbon dioxide. Simultaneously, the nitrogen oxides are decomposed and oxidized. In addition, since the organic silicon is rich in oxygen, it improves the combustion efficiency to decrease the carbon content in the exhaust gas, thereby to suppress the production of smoke. Usually, 0.2 mg to 2.5 mg of β-carboxy ethyl polysiloxane is added to 1 liter of hydrocarbon fuel.

Practical embodiments of the hydrocarbon fuel having improved combustion efficiency will be described hereinunder.

EMBODIMENT 1

200 mg of β carboxy ethyl polysiloxane was put into the fuel tank of a domestic type kerosene stove, together with 4 liters of kerosene. The mixture was sufficiently stirred before use. It was proved that the rate of fuel consumption is reduced almost to a half of that of the conventional fuel, under the same heat-generating conditions. Also, there was no bad smell at the lighting on and off of the stove.

| | rate of fuel consumption | smell |
|---|---|---|
| conventional fuel | 0.3 /h | bad smell |
| fuel of | | |

-continued

| | rate of fuel consumption | smell |
|---|---|---|
| invention | 0.15 /h | no smell |

EMBODIMENT 2

The concentrations of carbon monoxide and hydrocarbon in the exhaust emissions from an automobile engine using a fuel containing β-carboxy ethyl polysiloxane added to gasoline, were measured and the results are shown in the Table below

| | CO concentration | HC concentration |
|---|---|---|
| before addition | 3.5% | 300 ppm |
| after addition | 0.5% | 180 ppm |

Type of automobile:

Nissan Gloria 6 cylinders, with automatic transmission

Type of engine:

L20 made in 1973

In this embodiment, it was confirmed that the idling speed of the engine is increased as a result of addition of β carboxy ethyl polysiloxane. It is, therefore, necessary to effect such a slow adjust to adjust the speed of the engine by changing the air-fuel ratio of the mixture. This means that the combustion is improved by the addition of β carboxy ethyl polysiloxane. Wasteful combustion is prevented by a suitable change of air-fuel ratio. In addition, the combustion is completed quickly and at a lower temperature (measured at cooling water temperature) to contribute to the decrease of nitrogen oxide. It is remarkable that the fuel consumption rate was decreased from 5.2 Km/l down to 7.5 Km/l as a result of the slow adjust and the idling adjust.

Although the invention has been described through its preferred forms, it is to be understood that these embodiments are not exclusive and various changes and modifications may be imparted thereto without departing from the scope of the invention which is limited solely by the appended claims.

What is claimed is:

1. A hydrocarbon fuel having improved combustion efficiency which comprises a mixture of said hydrocarbon fuel and an amount effective to increase the combustion efficiency of said fuel of an organic silicon compound having the formula $(SiCH_2CH_2COOH)_nO_3$.

2. The hydrocarbon fuel according to claim 1 wherein said hydrocarbon fuel is gasoline or kerosene.

* * * * *